US005439319A

United States Patent [19]

Flanagan et al.

[11] Patent Number: 5,439,319

[45] Date of Patent: Aug. 8, 1995

[54] TUNNEL BARRIER SYSTEM AND METHOD OF INSTALLING THE SAME

[75] Inventors: Roy C. Flanagan, Dallas, Tex.; G. Richard Stauffer, Yardley, Pa.

[73] Assignee: Carlisle Coatings & Water Proofing, Incorporated, Sapulpa, Okla.

[21] Appl. No.: 105,993

[22] Filed: Aug. 12, 1993

[51] Int. Cl.[6] ..... E21D 11/00

[52] U.S. Cl. ..... 405/152; 156/287; 156/294; 405/146; 405/151

[58] Field of Search ..... 405/146, 150.1, 151, 405/154, 132, 152, 153; 156/287, 294

[56] References Cited

U.S. PATENT DOCUMENTS

| | | | |
|---|---|---|---|
| 3,418,812 | 12/1968 | Khan et al. | 405/150.2 X |
| 3,545,213 | 12/1970 | Sebor et al. | 405/150.2 |
| 3,698,066 | 10/1972 | Cornwell | 405/150.2 X |
| 3,818,710 | 6/1974 | Chlumecky . | |
| 3,861,154 | 1/1975 | Cooper . | |
| 4,075,855 | 2/1978 | Meldner . | |
| 4,199,158 | 4/1980 | de Munck | 277/205 |
| 4,456,401 | 6/1984 | Williams | 405/146 X |
| 4,477,204 | 10/1984 | Rohde et al. | 405/153 |
| 4,497,590 | 2/1985 | Chase | 405/152 |
| 4,797,032 | 1/1989 | Glang | 405/152 |
| 4,824,289 | 4/1989 | Glang et al. | 405/152 |
| 4,889,448 | 12/1989 | Bell | 405/135 |
| 4,900,607 | 2/1990 | Glang et al. | 428/131 |
| 4,946,309 | 8/1990 | Glang | 405/152 |
| 5,035,538 | 7/1991 | Mitchell | 405/151 |
| 5,044,823 | 9/1991 | Burgess | 405/152 |
| 5,074,711 | 12/1991 | Glang et al. | 405/152 |
| 5,305,798 | 4/1994 | Driver | 405/154 X |

FOREIGN PATENT DOCUMENTS

| | | | |
|---|---|---|---|
| 1233001 | 1/1967 | Germany | 405/152 |
| 4200007 | 7/1993 | Germany | 405/152 |

*Primary Examiner*—Dennis L. Taylor
*Attorney, Agent, or Firm*—Panitch Schwarze Jacobs & Nadel

[57] ABSTRACT

A tunnel barrier system for lining the interior surface of a tunnel cavity includes a first panel in facing engagement with and affixed to a first impermeable membrane. A second panel is in facing engagement with and is affixed to a second impermeable membrane. The second panel is positioned adjacent to but spaced apart from the first panel to form a cavity between the panels. A filling material is positioned within the cavity. A third impermeable membrane is in facing engagement with both the first and second impermeable membranes and extends across the cavity such that the first panel, the second panel and the cavity are rendered airtight and watertight.

15 Claims, 4 Drawing Sheets

TUNNEL BARRIER SYSTEM AND METHOD OF INSTALLING THE SAME

FIELD OF THE INVENTION

The present invention relates to a tunnel barrier system, and more particularly to a liner for lining a tunnel cavity having an interior surface, and a method of lining an interior surface of a tunnel cavity.

BACKGROUND OF THE INVENTION

Systems by which tunnels comprised of segments or panels are rendered water-resistant and air-resistant are known in the art. Several prior art methods for lining tunnels include the use of grooved members or brackets to guide tunnel segments in place combined with the use of packing material between individual tunnel segments. Other tunnel lining methods include attempts to heat seal the cavities between panels in a tunnel cavity in combination with spot tacking of vinyl sheeting on individual panels once the panels are installed in the tunnel cavity. While these methods are somewhat effective in rendering tunnels water-resistant, they are ineffective at rendering a tunnel watertight and airtight. Packing alone is not effective in that the packing is not generally airtight. Spot tacking of sheeting cannot provide an airtight or a sufficiently watertight barrier.

The barrier system of the present invention substantially renders both the panels and the cavities between the panels within a tunnel watertight and airtight thereby overcoming the disadvantages of the prior art. In addition, the panels may be rendered watertight prior to transportation to the tunnel construction site overcoming previous installation limitations and disadvantages as above-described.

It has been discovered that by affixing impermeable membranes to individual panels in a tunnel cavity; positioning filling material within the cavities between the panels in the tunnel cavity; and affixing additional impermeable membranes in facing engagement with the panel membranes such that the additional membranes extend from one panel membrane to an adjacent panel membrane and across the cavity between the adjacent panels, a tunnel barrier system is created which renders the panels and cavities between panels in a tunnel substantially watertight and airtight. Most tunnel cavities are generally pressurized by air. By providing a barrier which is airtight as well as watertight, the present invention substantially decreases the amount of air required to pressurize a tunnel cavity thereby reducing energy and other related costs associated with pressurizing a tunnel cavity.

SUMMARY OF THE INVENTION

Briefly stated, the tunnel barrier system of the present invention comprises a first panel having a first surface, a second surface and a side surface, the side surface defining a periphery of the first panel. The first surface of the first panel is in facing relationship with the interior surface of a tunnel cavity. The tunnel barrier system also comprises a first impermeable membrane having a first surface and a second surface. The first surface of the first membrane is affixed to and in facing engagement with the second surface of the first panel. A second panel having a first surface, a second surface and a side surface defining a periphery of the second panel is positioned adjacent to, but spaced apart from the first panel thereby forming a cavity between a portion of the side surface of the first panel and a portion of the side surface of the second panel. A second impermeable membrane having a first surface and a second surface is affixed to the second surface of the second panel. The first surface of the second membrane is in facing engagement with the second surface of the second panel. A filling material is positioned within the cavity between the first and second panels. A third impermeable membrane having a first and a second surface is affixed to both the first and second membranes. The first surface of the third membrane is in facing engagement with the second surfaces of the first and second membranes. The third membrane extends across the cavity between the first and second panels such that the first panel, the second panel and the cavity are impermeable to fluids.

The present invention also comprises a layered membrane which can be adhered to a surface of a panel. The layered membrane comprises a fluid impermeable layer having a first and second surface. The fluid impermeable layer is affixed to a protective film having a first and a second surface such that the second surface of the fluid impermeable layer is in facing engagement with the first surface of the protective film. The protective film is configured to leave a margin of the exposed fluid impermeable layer on at least one side of the perimeter of the second surface of the fluid impermeable layer. The layered membrane also comprises a paper release sheet removably attached to the first surface of the fluid impermeable layer and a removable edge trim in facing engagement with the exposed margin of fluid impermeable layer.

The present invention also comprises a method for lining an interior surface of a tunnel cavity. The method comprises the step of installing a first panel having a first surface, a second surface and a side surface, the side surface defining a periphery of the first panel in a tunnel cavity such that the first surface of the first panel is positioned in facing relationship with the interior surface of the tunnel cavity. A second panel, also having a first surface, a second surface and a side surface, the side surface defining a periphery of the second panel, is installed in the tunnel cavity with the first surface of the second panel in facing relationship with the interior surface of the tunnel cavity. The side surface of the second panel is adjacent to but spaced apart from the side surface of the first panel to form a cavity between a portion of the side surface of the first panel and a portion of the side surface of the second panel. A first impermeable membrane having a first and second surface is affixed to the first panel. The first surface of the first membrane is in facing engagement with the second surface of the first panel. A second impermeable membrane having a first surface and a second surface is affixed to the second panel. The first surface of the second membrane is in facing engagement with the second surface of the second panel. A filling material is inserted in the cavity between the adjacent side surfaces of the first and second panels. A third impermeable membrane having a first and second surface is affixed to the first and second membranes. The first surface of the third membrane is placed in facing engagement with the second surfaces of the first and second membranes, and the third membrane extends across the cavity such that the first panel, second panel and cavity are impermeable to fluids.

BRIEF DESCRIPTION OF THE DRAWINGS

The foregoing summary, as well as the following detailed description of the preferred embodiment of the invention, will be better understood when read in conjunction with the appended drawings. The drawings show a presently preferred embodiment for the purpose of illustrating the invention. It should be understood, however, that the invention is not limited to the precise arrangements and instrumentalities shown. In the drawings.

DETAILED DESCRIPTION OF THE PREFERRED EMBODIMENT

Figure 1:
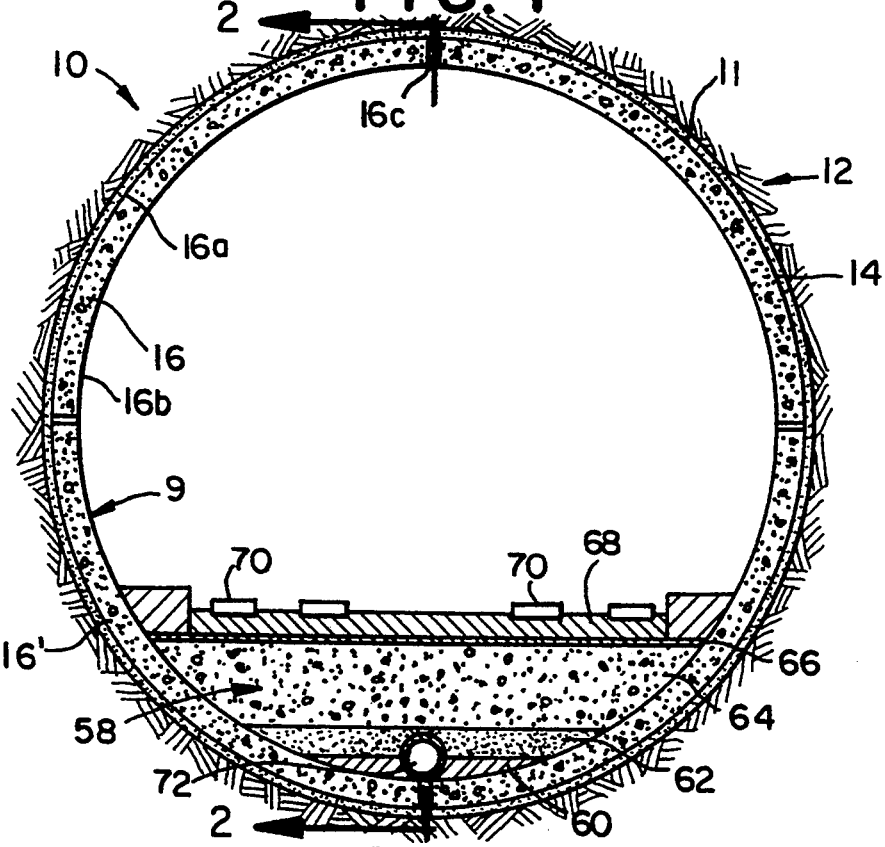
FIG. 1 is a cross-sectional view of a tunnel cavity including a tunnel barrier system in accordance with the present invention.
Figure 2:
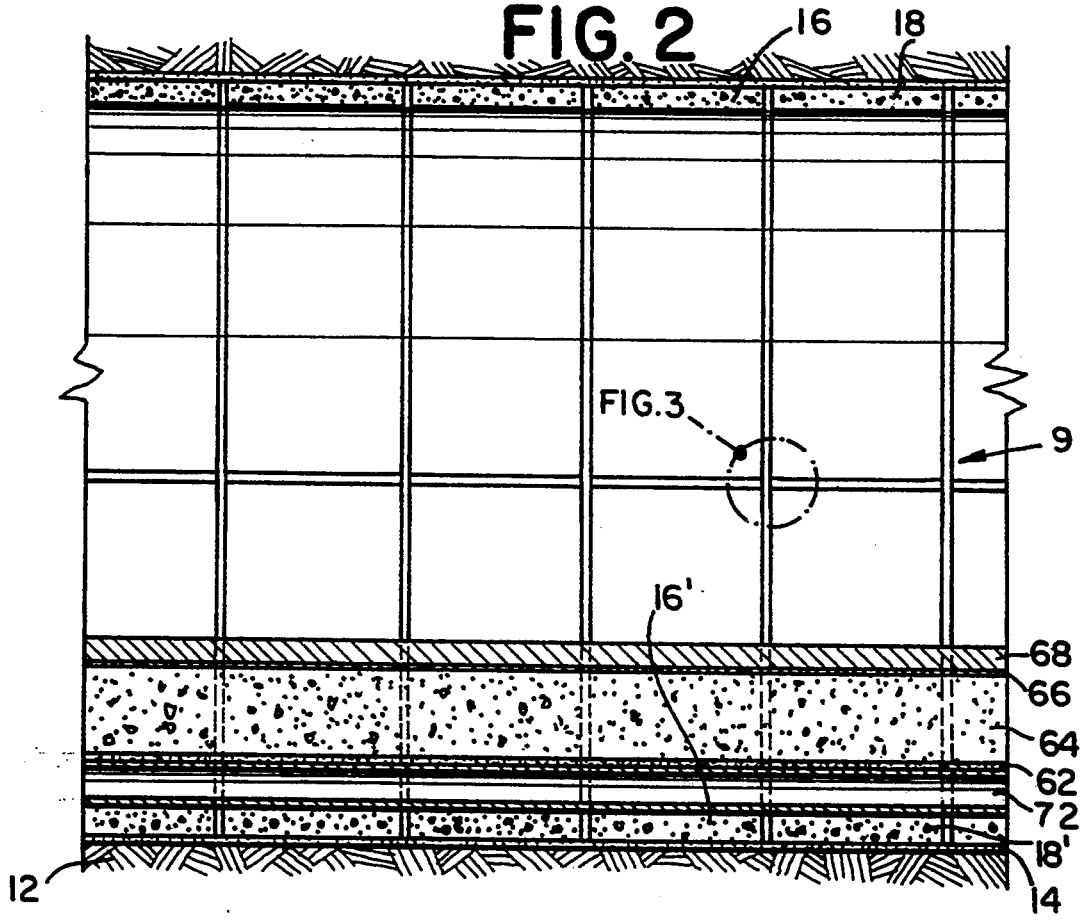
FIG. 2 is a cross-sectional view of the tunnel cavity shown in FIG. 1 taken along line 2—2 of FIG. 1.

Referring to the drawings in detail, wherein like numerals indicate like elements throughout, there is shown in FIGS. 1–7, a preferred embodiment of a tunnel barrier system, generally designated 9, in accordance with the present invention. A tunnel cavity 10, having an interior surface 11, is shown in FIGS. 1 and 2. The tunnel cavity 10 may be any tunnel cavity which is excavated, blasted or otherwise cleared either above or below ground through earth, rock, water or other like media. FIG. 1 shows a layer of earth 12 defining the tunnel cavity 10. In the present embodiment, the tunnel cavity 10 is lined with a layer of grout 14. It is understood by one skilled in the art that many types of suitable grouting, including but not limited to pre-cast concrete may be used to line the interior surface 11. The tunnel cavity 10 as depicted is generally circular in cross-section, however, it is understood that the present invention is not limited by circular geometry and may be practiced in any tunnel cavity geometry, including generally rectangular, square, triangular and so forth.

Referring now to FIGS. 1 and 2, the tunnel barrier system 9 includes a first panel 16 and a second panel 18. The first panel 16 has a first surface 16*a*, a second surface 16*b* and a side surface 16*c* defining a periphery of the first panel 16. In a similar fashion, the second panel 18 includes a first surface 18*a*, a second surface 18*b* and a side surface 18*c* defining a periphery around the second panel 18.

The first panel 16 and the second panel 18 are placed in the tunnel cavity 10 such that the first surface 16*a* of the first panel 16 and the first surface 18*a* of the second panel 18 are in facing relationship with the interior surface 11 of the tunnel cavity 10. In addition, the first panel 16 and the second panel 18 are positioned such that a portion of the side surface 16*c* of the first panel 16 is adjacent to but spaced apart from a portion of the side surface 18*c* of the second panel 18 thereby creating a vertical cavity 22 between the portion of the side surface 16*c* of the first panel 16 and the portion of the side surface 18*c* of the second panel 18.

As mentioned above, the tunnel cavity 10 is generally circular in cross-section. In the present embodiment, the first panel 16 and the second panel 18 are generally in the form of a quarter segment of a wall forming a generally cylindrical tube. However, the geometry of the particular panels used in any particular embodiment of the tunnel barrier system 9 of the present invention may vary depending upon the tunnel architecture, design and geometry. Thus, it is understood by those skilled in the art that the first and second panels 16, 18 could be also be generally planar, square, triangular, or any other similar configuration as long as the shape of the first and second panels 16,18 generally correspond to the shape of the interior surface 11 of the tunnel cavity 10.

Preferably, the first panel 16 and the second panel 18 are constructed of concrete. It is understood that the first and second panels 16, 18 may be constructed of other acceptable tunnel building materials such as steel reinforced concrete or pre-cast concrete.

In a tunnel cavity 10, which is fully lined with the tunnel barrier system 9 of the present invention, the first panel 16 and the second panel 18 comprise only two of a plurality of panels used in lining the entire interior surface 11 of the tunnel cavity 10. As such, further panels 16' and 18', with cavities therebetween, for example, are added to completely line the interior surface 11 of the tunnel cavity 10. It is therefore understood by those skilled in the art that the present invention is not limited to using a particular number of panels to line the interior surface 11 of the tunnel cavity 10.

Figure 5:
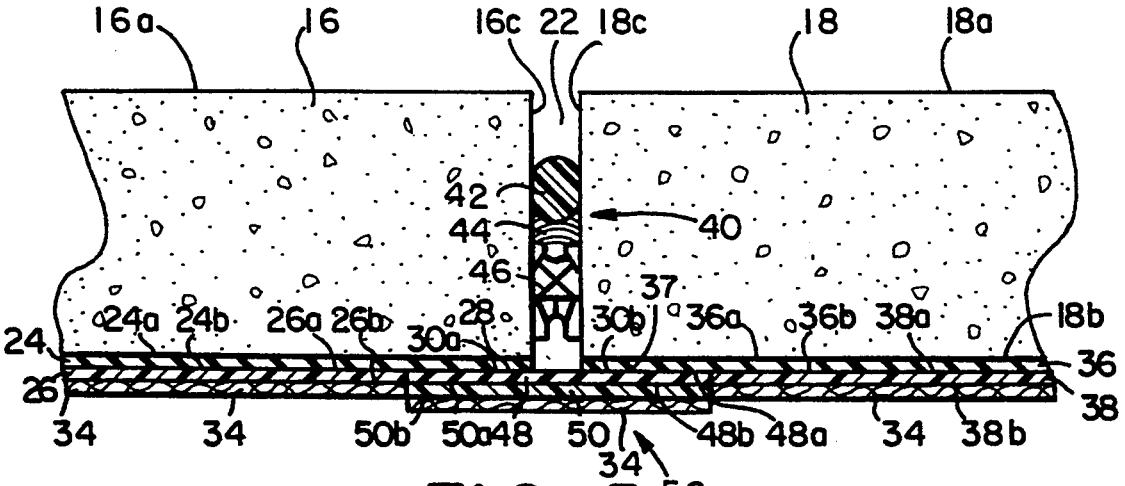
FIG. 5 is a greatly enlarged cross-sectional view of a portion of the tunnel barrier system in FIG. 3 taken along line 5—5 of FIG. 3.

Referring now to FIG. 5, the tunnel barrier system 9 further includes a first impermeable membrane 24 having a first surface 24*a* and a second surface 24*b*. Preferably, the first impermeable membrane 24 is comprised of rubberized asphalt. However, it is understood by those skilled in the art that the first impermeable membrane 24 may be comprised of other comparable materials such as other rubbers or elastomers. In addition, the first impermeable membrane 24 is preferably 78 mils thick, however, the thickness may be varied depending upon the type of panels 16, 18 used and the particular application of the tunnel barrier system 9.

The first surface 24*a* of the first impermeable membrane 24 is affixed by application of an adhesive primer to the second surface 16*b* of the first panel 16. The second surface 16*b* of the first panel 16 is in facing engagement with the first surface 24*a* of the first impermeable membrane 24. Preferably, the first impermeable membrane 24 is sized to correspond to the surface area of the second surface 16*b* of the first panel 16.

Figure 6:
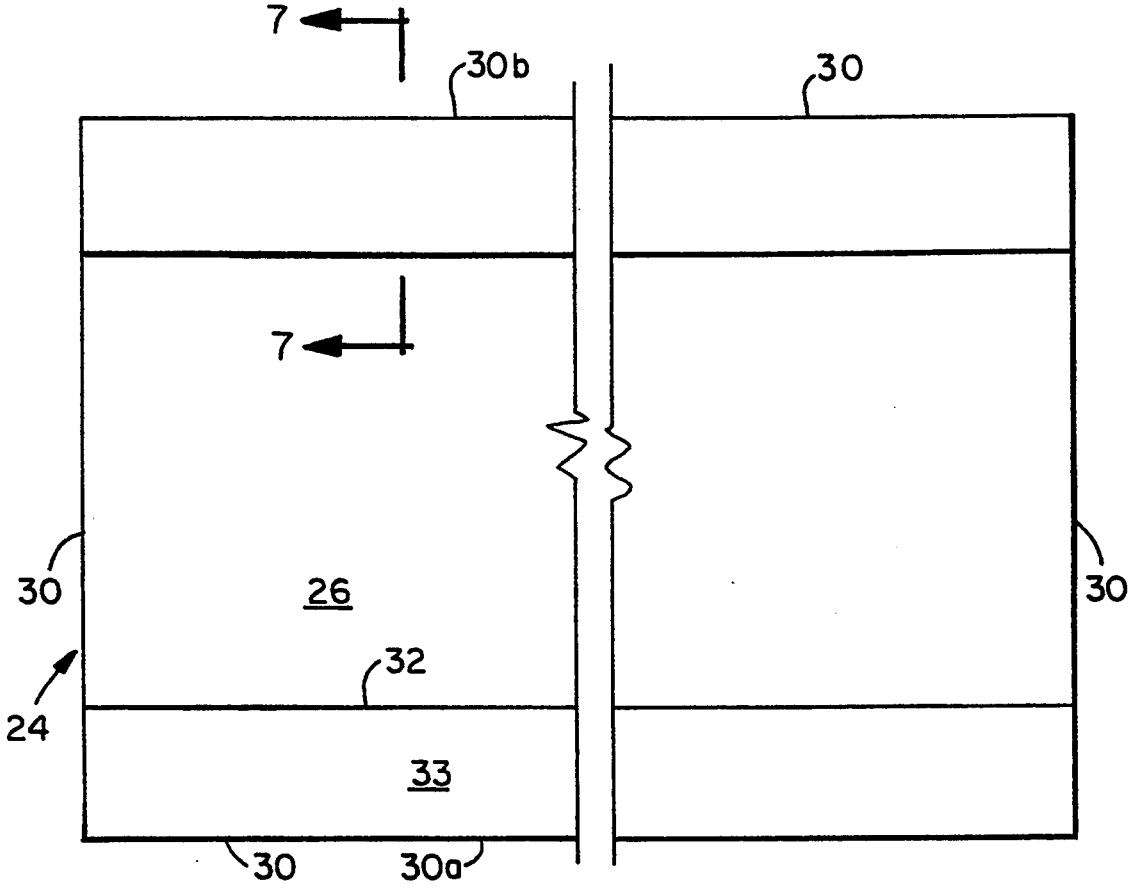
FIG. 6 is a plan view of an enlarged layered membrane in accordance with the present invention.
Figure 7:
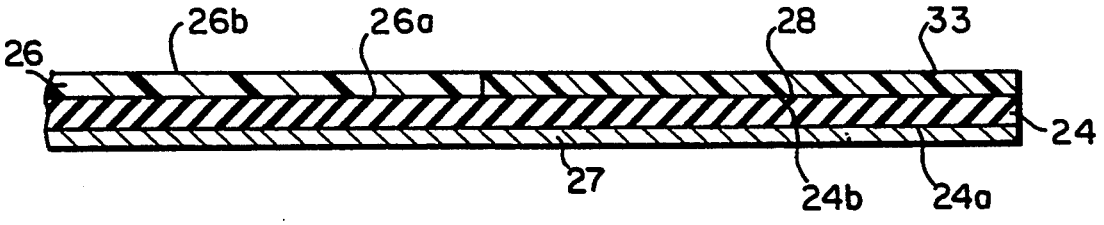
FIG. 7 is a greatly enlarged cross-sectional view of the membrane shown in FIG. 6 taken along line 7—7 of FIG. 6.

In the present embodiment, as shown in FIGS. 5–7, the tunnel barrier system 9 further comprises a first protective film 26 having a first surface 26*a* and a second surface 26*b*. The first surface 26*a* of the first protective film 26 is affixed in the form of a laminate to the second surface 24*b* of the first impermeable membrane 24 such that the first surface 26*a* of the first protective film 26 is in facing engagement with the second surface 24*b* of the first impermeable membrane 24.

The first protective film 26 is preferably comprised of a polymeric material. More preferably the first protective film 26 is comprised of polyethylene. Further, the first protective film 26 is preferably 12 mils thick. However, it is understood by one skilled in the art that the first protective film can be constructed of other polymeric materials, such as polyethylene, and that the thickness of the protective film 26 may be varied depending upon the conditions within the tunnel cavity 10 such that a different thickness or material protective film 26 may be substituted to protect against the particular internal conditions of the tunnel cavity 10.

As best shown in FIG. 7, a paper release sheet 27 is removably attached to the first surface 24*a* of the first impermeable membrane 24. The paper release sheet 27 serves as a protective covering for the first surface 24*a* of the first impermeable membrane 24 keeping it free from debris and protecting it from other external forces which could breach the integrity of the first impermeable membrane 24. The paper release sheet 27 preferably includes a siliconized backing (not shown) which allows the paper release sheet 27 to be easily removed or peeled away from the first surface 24*a* of the first impermeable membrane 24 prior to attaching the first impermeable membrane 24 to the first panel 16.

Referring now to FIGS. 5–7, in the present embodiment, the first surface 26*a* of the first protective film 26, is configured on the second surface 24*b* of the first impermeable membrane 24 to leave a margin 28 of exposed first impermeable membrane 24 on at least one side of the perimeter but preferably on two opposing sides 30*a*, 30*b* of the second surface 24*b* of the first impermeable membrane 24 such that the margin 28 is adjacent to the vertical cavity 22. While it is preferred to leave a margin 28 of exposed first impermeable membrane 24 on two opposing sides 30*a*, 30*b* of the second surface 24*b* of the first impermeable membrane 24, the margin 28 may exist on one, three or four or more sides of the perimeter 30 of the first impermeable membrane 24 or be omitted entirely.

As best shown in FIG. 6, it is preferred that the margin 28 be equivalent in width on both of the opposing sides 30*a*, 30*b* of the perimeter 30 of the first impermeable membrane 24. The width of the margin 28 is measured outwardly and perpendicularly from a peripheral edge 32 of the first protective film 26 to the perimeter 30 of the first impermeable membrane 24. The margin 28 has a width of at least three inches, and preferably has a width of six inches. The margin 28 or exposed second surface 24*b* of the first impermeable membrane 24 is in facing engagement with a removable edge trim 33. The edge trim 33 functions to protect the integrity of the exposed second surface 24*b* or margin 28 of the first impermeable membrane 24. The edge trim 33 is preferably a removable or peel-away adhesive tape or substrate constructed of polyethylene. However, it is understood by those skilled in the art that other materials such as silicone film may be used to construct the edge trim 33.

Figure 4:
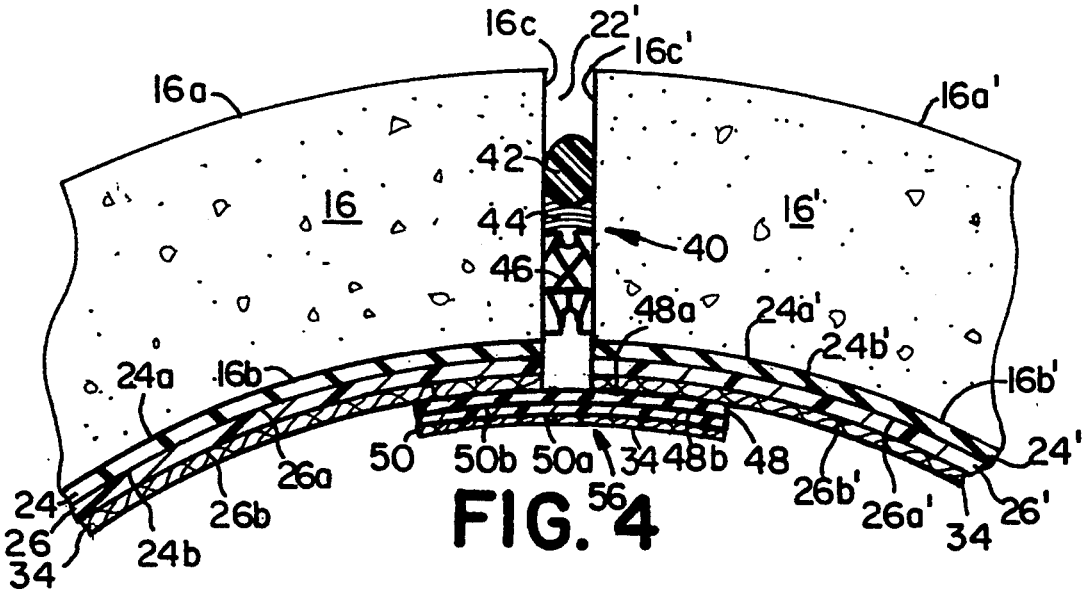
FIG. 4 is a greatly enlarged cross-sectional view of a portion of the tunnel barrier system shown in FIG. 3 taken along line 4—4 of FIG. 3.

Referring now to FIGS. 4 and 5, in the present embodiment, after the first impermeable membrane 24 is affixed to the first panel 16, a fabric layer 34 is placed in facing engagement with the second surface 26*b* of the first protective film 26. The fabric layer 34, which acts as an additional protective layer for the first impermeable membrane 24, is comprised of a coarse of non-woven fabric and applied to the second surface 26*b* of the first protective film 26 by an adhesive primer. Preferably, the fabric layer 34 does not extend over the area comprising the margin 28.

A portion of a second impermeable membrane 36 having a first surface 36*a* and a second surface 36*b* is shown in FIG. 5. The first surface 36a of the second impermeable membrane 36 is affixed to the second surface 18*b* of the second panel 18 in the same manner that the first surface 24*a* of the first impermeable membrane 24 is affixed to the second surface 16*b* of the first panel 16. The second impermeable membrane 36 further comprises a second protective film 38 having a first surface 38*a* and a second surface 38*b*. A fabric layer 34 is in facing engagement with the second surface 38*b* of the second protective film 38. The first surface 38*a* of the second protective film 38 is affixed to the second surface 36*b* of the second impermeable membrane 36. The second impermeable membrane 36 and the manner in which it is affixed to the second panel 18 are generally identical to the first impermeable membrane 24 and the manner in which it is affixed to the first panel 16, respectively, and, therefore, further description thereof is omitted for purposes of convenience only and is not limiting.

Referring now to FIG. 5, a filling material 40 is positioned within the vertical cavity 22. In the presently preferred embodiment, the filling material 40 is comprised of a closed cell backer rod 42 inserted within the vertical cavity 22. The closed cell backer rod 42 is preferably sized such that it is compressed and generally elliptical in cross-section when it is positioned within the vertical cavity 22. The cross-sectional geometry of the backer rod 42 is not limited to any particular configuration and may be generally square, rectangular or triangular without departing from the spirit and scope of the invention. In addition, the closed cell backer rod 42 may be hollow or solid. The closed cell backer rod 42 is preferably comprised of polyethylene, however, it is understood that other materials such as butyl rubber may be used.

A sealant 44 is inserted into the vertical cavity 22 proximate to the closed cell backer rod 42. A sufficient amount of sealant 44 is inserted into the vertical cavity 22 such that the area between the side surfaces 16*c*, 18*c* of the first and second panels 16, 18 is filled. The sealant 44 is preferably constructed of polyurethane, however, it is understood by those skilled in the art that similar sealants, such as silicone, may also be used.

The filling material 40 is further comprised of a compression seal 46 inserted into the vertical cavity 22 proximate to the sealant 44. The compression seal 46 is preferably constructed of neoprene. However, the compression seal 46 may be comprised of other materials, such as plastic, silicon, or other types of rubber.

It is understood by those skilled in the art that other filling materials, including gaskets, rubberized cloth or sheet, or other similar packing material which is adjustable to extend across the vertical cavity 22 to prevent or minimize the passage of water or air through the vertical cavity 22 may be used for this purpose, without departing from the spirit and scope of the invention.

Referring now to FIGS. 4 and 5, the tunnel barrier system 9 further includes a third impermeable membrane 48 having a first surface 48*a* and a second surface 48*b*. The third impermeable membrane 48 is comprised of the same material as the first and second impermeable membranes 24, 36, except as described hereinafter. Preferably, the third impermeable membrane 48 is of equal or greater width than the sum of the width of the margin 28 on the first impermeable membrane 24, the width of the margin 37 of the second impermeable 36 and the width of the vertical cavity 22. More preferably, the third impermeable membrane is 12 inches wide or greater. The first surface 48*a* of the third impermeable membrane 48 is adhesively fixed in facing engagement to the exposed margin 28, of the second surface 24*a* of the first impermeable membrane 24 and the exposed margin 37 of the second surface 36*b* of the second impermeable membrane 36, respectively. The third impermeable membrane 48 extends across the vertical cavity 22 and the filling material 40 therein, such that the first panel 16, the second panel 18 and the vertical cavity 22 are impermeable to fluids, including both air and water.

Like the first and second impermeable membranes 24, 6 the third impermeable membrane 48 comprises a third protective film 50 having a first surface 50*a* and a second surface 50*b*. The first surface 50*a* of the third protective film 50 is in facing engagement with the entire surface area of the second surface 48*b* of the third impermeable membrane 48. Thus, the third impermeable membrane 48 does not include an exposed margin or removable edge trim.

The third impermeable membrane 48 preferably comes in the form of rolled rubberized asphalt, resembling a tape (not shown). This rolled form comprises a finite length of a continuous third impermeable membrane 48. The continuous third impermeable membrane 48 is applied across all cavities created between adjacent panels in a tunnel barrier system which comprises a plurality of panels.

Figure 3:
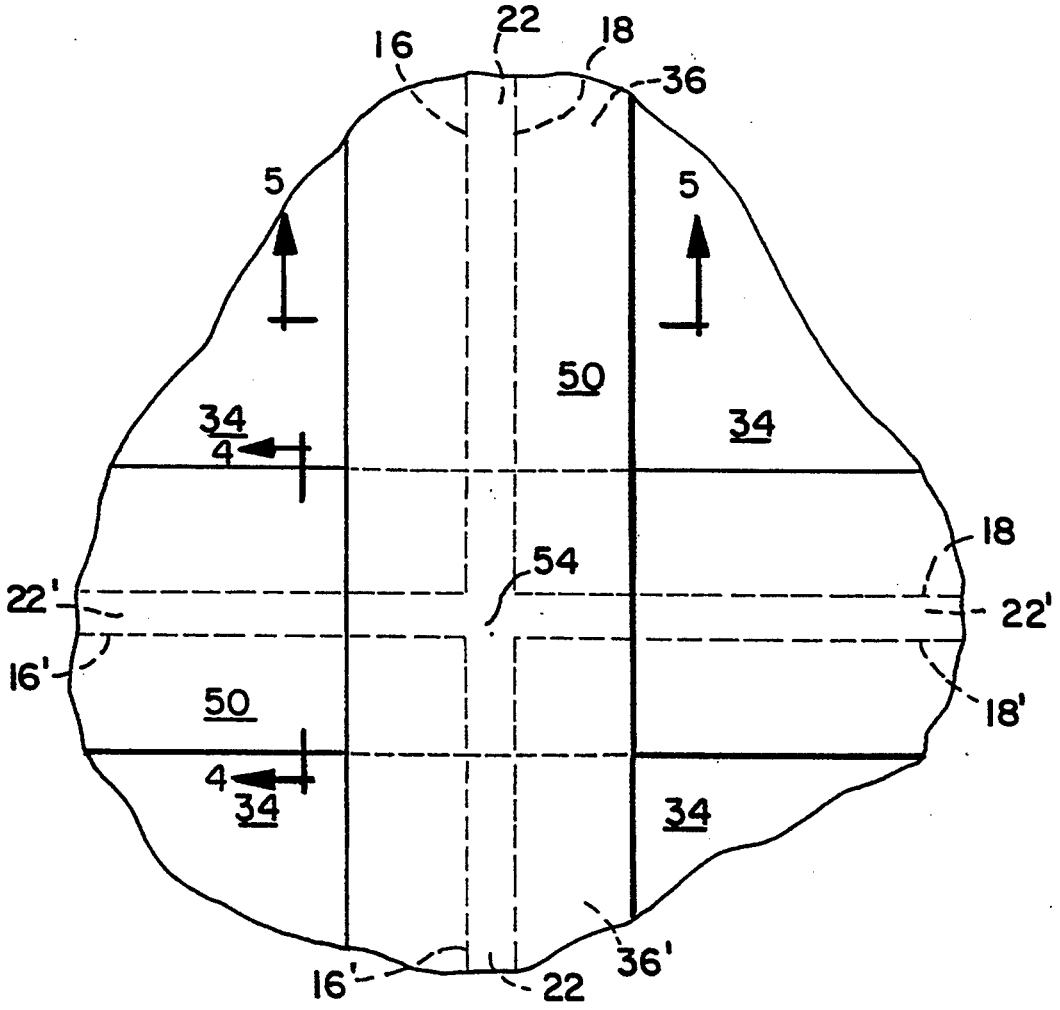
FIG. 3 is a greatly enlarged fragmentary view of a portion of the-tunnel barrier system shown in FIG. 2.

FIGS. 2 and 3 show an area in which the first panel 16, a third panel 16', a second panel 18 and a fourth panel 18' meet to form a cavity intersection 54. As shown in FIGS. 3 and 4, the third impermeable membrane 48 and the third protective film 50 extend horizontally from the portion of the horizontal cavity 22' between the first and third panels 16, 16', across the intersection 54, to the portion of the horizontal cavity 22' between the second and fourth panels 18, 18'. The third impermeable membrane 48 and third protective film 50 also extend vertically from the portion of the vertical cavity 22 between the first and second panels 16, 18, across the intersection 54 thereby overlapping the horizontally extending third impermeable membrane 48 and third protective film 50, to the cavity 22 between the third and fourth panels 16', 18'. As shown in FIGS. 4 and 5, a fabric layer 34 is placed in engagement with the third protective film 50 in a manner identical to that described above in connection with first impermeable membrane 24. It is understood by those skilled in the art that the third impermeable membrane 48 and third protective film 50 can be applied in any order and in any direction across the cavities 22, 22', including diagonally, depending upon the method of construction and the configuration of panels in a particular tunnel cavity.

The tunnel barrier system 9 of the present invention is shown in FIG. 4 as it appears between the first panel 16 and the third panel 16'. As shown, the protective film 26 extends the full length of the first membrane 24 to the cavity 22' without leaving a margin.

The third panel 16' has a first surface 16*a'*, a second surface 16*b'* and a side surface 16*c'* which defines a periphery of the third panel 16'. Like panels 16 and 18, the second surface 16*b'* of the third panel 16' is in facing engagement with a fourth adhesive membrane 24' having a first surface 24*a'* and a second surface 24*b'*. The first surface 24*a'* of the fourth adhesive membrane 24' is affixed by application of an adhesive primer to the second surface 16*b'* of the third panel 16'.

As shown in FIG. 4, the fourth impermeable membrane 24' further comprises a fourth protective film 26' having a first surface 26*a'* and a second surface 26*b'*. The fourth protective film 24' is identical to the first protective film 26 attached to the first panel 16. In the tunnel barrier system 9 as shown between panels 16 and 16', the fourth protective film 26' extends the full length of the fourth membrane 24' to the cavity 22' in the same manner as the first protective film 26.

Referring to FIG. 4, after the fourth impermeable membrane 24' is affixed to the third panel 16', a fabric layer 34 identical to that affixed to the first impermeable membrane 24 is placed in facing engagement with the entire surface area of the second surface 26*b'* of the fourth protective film 26' That is, the fabric layer 34 as depicted in FIG. 4 extends the entire length of the protective film 26'.

The filling material 40 is inserted in the horizontal cavity 22' between the first panel 16 and the third panel 16' exactly as the filling material 40 is inserted in the vertical cavity 22 between the first panel 16 and the second panel 18. The first surface 48*a* of the third impermeable membrane 48 is adhesively fixed in facing engagement to the fabric layer 34 attached to the second surface 26*b* of the first protective film 26 and the second surface 26*b'* of the fourth protective film 26', respectively. The third impermeable membrane 48 extends across the horizontal cavity 22' and the filling material 40 therein, such that the first panel 16, the third panel 16' and the horizontal cavity 22' are impermeable to fluids, including both air and water.

The filling material 40, the third impermeable membrane 48 and third protective film 50 together comprise a sealed joint 56. The sealed joint 56 may be used in any tunnel cavity 10 comprising a plurality of adjacent panels having cavities between the panels.

Referring now to FIGS. 1 and 2, after installation of the tunnel barrier system as described above, the tunnel cavity 10 further includes a foundation 58. For example, the foundation 58 comprises a base concrete slab 60, a further grouting layer 62, a ballast foundation course 64, an asphalt layer 66, a top concrete slab 68, and a conveying means such as a railroad track 70. In addition, a drainage pipe 72 or other drainage means may be provided which extends the length of the foundation 58 from one end of the tunnel cavity 10 to the other end of the tunnel cavity 10. It is understood by those skilled in the art that the present invention is not directed to any particular foundation 58 and, therefore, further description thereof is omitted for purposes of convenience only and is not limiting.

The method of lining the interior surface 11 of the tunnel cavity 10 with the tunnel barrier system 9 will now be described with respect to the first, second, third and fourth panels 16, 18, 16' and 18' but is equally applicable to the installation of all of the panels needed to line the interior surface 11. First a primer (not shown) is applied to the second surfaces 16*b*, 18*b*, 16*b'*, 18*b'* of each of the first, second, third and fourth panels 16, 18, 16', 18' at a construction yard or other location outside the tunnel cavity although the primer could be applied at the site of the tunnel. The second surfaces 16*b*, 18*b*, 16*b'*, 18*b'* are preferably made to be dry, smooth and free of voids and sharp protrusions prior to applying the primer. After the primer is applied to the dry and smooth second surfaces 16*b*, 18*b*, 16*b'*, 8*b'* of the first, second, third and fourth panels 16, 18, 6*b'*, 18*b'* the primer is allowed to dry thoroughly for a period of not less than approximately one hour nor more than approximately eight hours.

The paper release sheets 27 are then removed, one at a time, from the first surfaces 24*a*, 36*a*, and 24*a'* of the first, second, and fourth impermeable membranes 24, 36, 24', as well as from the first surface 36*a'* of a fifth impermeable membrane 36' having a first surface 36*a'* and a second surface 36*b'*, to expose the first surfaces 24*a*, 36*a*. The fifth membrane 36' is in facing engagement with a fifth protective film (not shown). The first surfaces 24*a*, 36*a*, 24*a'* of the first, second, fourth and fifth impermeable membranes 24, 36, 24', 36' (the first surface of the fifth membrane 36' is not shown) are then affixed, one at a time, in facing engagement to the prepared second surfaces 16*b*, 18*b*, 16*b'*, 18*b'* of the first, second, third and fourth panels 16, 18, 16' 18' respectively, and the impermeable membranes 24, 36, 24', 36' are smoothed by hand or a roller mechanism (not shown).

After the first, second, fourth and fifth impermeable membranes 24, 36, 24', 36' are affixed to the first, second, third and fourth panels 16, 18, 16', 18', a layer of fabric 34 is applied in facing engagement to the surface area of the second surface 26*b*, 38*b*, 26*b'* of each of the first, second, fourth and fifth (not shown) protective films 26, 38, 26' without overlapping the removable edge trim. The layer of fabric 34 is applied in facing engagement with the second surfaces 26*b*, 26*b'*, 38*b*, of the first, second fourth and fifth protective films 26, 26', 38 by applying a primer to the second surfaces 26*b*, 38*b*, 26*b'* of the first, second, fourth and fifth protective films 26, 38, 26', and then applying the layer of fabric 34 to the primer.

The first, second, third and fourth panels 16, 18, 6', 18' having the first, second, fourth and fifth impermeable membranes 24, 36, 24', 36', respectively, already affixed as above-described are then transported to the site of the tunnel cavity 10 and installed therein in a manner well understood by those skilled in the art. The first panel 16 is installed in the tunnel cavity 10 such that the first surface 16a is in facing relationship with the interior surface 11 of the tunnel cavity 10. The second panel 18 is installed in the tunnel cavity 10 in the same manner as the first panel 16, and is positioned such that a portion of the side surface 18*c* of the second panel 18 is adjacent to but spaced apart from a portion of the side surface 16*c* of the first panel 16 such that the vertical cavity 22 is formed between the portion of the side surface 18*c* of the second panel 18 and the portion of the side surface 16*c* of the first panel 16.

The third panel 16' and the fourth panel 18' are installed in the tunnel cavity 10 in the same manner as the first panel 16. The third panel 16' is positioned such that a portion of the side surface 16*c'* of the third panel 16' is adjacent to but spaced apart from a portion of the side surface 16*c* of the first panel 16 such that a horizontal cavity 22' is formed between the portion of the side surface 16*c'* of the third panel 16' and the portion of the side surface 16*c* of the first panel 16. The third panel 16' is also positioned such that a portion of the side surface 16*c'* of the third panel 16' is also adjacent to but spaced apart from a portion of the side surface 18*c'* of the fourth panel 18' such that the vertical cavity 22 formed between the portion of the side surface 16*c* of the first panel 16 and the portion of the side surface 18*c* of the second panel 18 continues between the portion of the side surface 16*c'* of the third panel 16' and the portion of the side surface 18*c'* of the fourth panel 18'. The fourth panel 18' is also positioned such that a portion of the side surface 18*c'* of the fourth panel 18' is adjacent to but spaced apart from a portion of the side surface 18*c* of the second panel 18 such that the horizontal cavity 22' formed between a portion of the side surface 16*c'* of the third panel 16' and a portion of the side surface 16*c* of the first panel 16 continues between the portion of the side surface 18*c'* of the fourth panel 18' and the portion of the side surface 18*c* of the second panel 18.

Next, the filling material 40 is inserted into the horizontal cavity 22' and the vertical cavity 22. That is, the closed cell backer rod 42 is inserted into each of the horizontal and vertical cavities 22, 22'. After the closed cell backer rods 42 are in place, the sealant 44 is inserted into the horizontal and vertical cavities 22, 22' proximate to the closed cell backer rods 42. Then, the compression seal 46 is inserted into each of the horizontal and vertical cavities 22, 22' such that the compression seal 46 is proximate to the sealant 44.

Once the filling material 40 is in place within the horizontal and vertical cavities 22, the edge trim 33 is removed from the second surfaces 24*b*, 36*b* of the first and second impermeable membranes 24, 36 exposing the margins 28, 37 on the second surfaces 24*b*, 36*b* of the first and second impermeable membranes 24, 36. The fourth and fifth impermeable membranes 24', 36' also have identical margins (not shown) to those margins 28, 37 of the first and second impermeable membranes 24, 36. The edge trim 33 is also removed from the fourth and fifth impermeable membranes 24', 36' to expose the margins thereof.

The first surface 48*a* of the third impermeable membrane 48 is then affixed to the fabric layers 34 of the first, second, third and fourth panels 16, 16', 18, 18' such that the third impermeable membrane 48 extends longitudinally across the horizontal cavity 22' with approximately equal portions of the third impermeable membrane 28 overlapping transversely across the horizontal cavity 22', and such that the third impermeable membrane 48 extends across the intersection 54 between the four panels 16, 16', 18, 18' and is directly applied to the portions of the exposed margins proximate the intersection 54.

The first surface 48*a* of the third impermeable membrane 48 is then affixed to the margins of the second surfaces 24*b*, 24*b'* of the first and fourth impermeable membranes 24, 24*b'* and to the margins of the second surfaces 36*b* of the second and fifth impermeable membranes 36, 36' such that the third impermeable membrane 48 extends across the vertical cavity 22 and overlaps the third impermeable membrane 48 which extends across the horizontal cavity 22' at the point of intersection 54 and such that the first, second, third and fourth panels 16, 16', 18, 18', and the horizontal and vertical cavities 22, 22' are impermeable to fluids.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A tunnel barrier system for lining a tunnel cavity having an interior surface, said tunnel barrier system comprising:

(a) a first panel having a first surface, a second surface, and a side surface defining a periphery of said first panel, said first surface of said first panel being in facing relationship with the interior surface;

(b) a first impermeable membrane having a first surface and a second surface, said first surface of said first membrane being affixed to said second surface of said first panel such that said first surface of said first membrane is in facing engagement with said second surface of said first panel;

(c) a second panel having a first surface, a second surface, and a side surface defining a periphery of said second panel, said first surface of said second panel being in facing relationship with the interior surface, a portion of said side surface of said first panel being positioned adjacent to but spaced apart from a portion of said side surface of said second panel such that a cavity is formed between said portion of said side surface of said first panel and said portion of said side surface of said second panel;

(d) a second impermeable membrane having a first surface and a second surface, said first surface of said second membrane being affixed to said second surface of said second panel such that said first surface of said second membrane is in facing engagement with said second surface of said second panel;

(e) a filling material positioned within said cavity; and (f) a third impermeable membrane having a first surface and a second surface, said first surface of said third membrane being in facing engagement with said second surface of said first membrane and said second surface of said second membrane, said third membrane extending across said cavity such that said first panel, said second panel and said cavity are impermeable to fluids.

2. The tunnel barrier system of claim 1, wherein said first panel and said second panel are constructed of concrete.

3. The tunnel barrier system of claim 1, wherein said first membrane, said second membrane and said third membrane comprise rubberized asphalt.

4. The tunnel barrier system of claim 1, wherein said filling material within said cavity comprises:

(a) a closed cell backer rod positioned within said cavity;

(b) a sealant positioned within said cavity proximate to said backer rod; and (c) a compression seal positioned within said cavity proximate to said sealant.

5. The tunnel barrier system of claim 1, further comprising a first protective film having a first surface and a second surface, said first surface of said first protective film being in facing engagement with said second surface of said first membrane, a second protective film having a first surface and a second surface, said first surface of said second protective film being in facing engagement with said second surface of said second membrane and a third protective film having a first surface and a second surface, said first surface of said third protective film in facing engagement with said second surface of said third membrane.

6. The tunnel barrier system of claim 5, wherein said first protective film, said second protective film and said third protective film comprise a polymeric material.

7. The tunnel barrier system of claim 5, wherein said first protective film is configured to leave a margin of exposed first membrane on at least one side of two opposing sides of a perimeter of said second surface of said first membrane and said second protective film is configured to leave a margin of exposed second membrane on at least one side of two opposing sides of a perimeter of said second surface of said second membrane such that said margin on said second surface of said first membrane and said margin on said second surface of said second membrane are adjacent to said cavity.

8. The tunnel barrier system of claim 7, wherein said second surface of said first protective film is in facing engagement with a first layer of fabric and said second surface of said second protective film is in facing engagement with a second layer of fabric.

9. A tunnel barrier system for lining a tunnel cavity having an interior surface, said tunnel barrier system comprising:

(a) a first panel having a first surface, a second surface, and a side surface defining a periphery of said first panel, said first surface of said first panel being in facing relationship with the interior surface;

(b) a first impermeable membrane having a first surface and a second surface, said first surface of said first membrane being affixed to said second surface of said first panel such that said first surface of said first membrane is in facing engagement with said second surface of said first panel;

(c) a first protective film having a first surface and a second surface, said first surface of said first protective film being in facing engagement with said second surface of said first membrane;

(d) a second panel having a first surface, a second surface, and a side surface defining a periphery of said second panel, said first surface of said second panel being in facing relationship with the interior surface, a portion of said side surface of said first panel being positioned adjacent to but spaced apart from a portion of said side surface of said second panel such that a cavity is formed between said portion of said side surface of said first panel and said portion of said side surface of said second panel;

(e) a second impermeable membrane having a first surface and a second surface, said first surface of said second membrane being affixed to said second surface of said second panel such that said first surface of said second membrane is in facing engagement with said second surface of said second panel;

(f) a second protective film having a first surface and a second surface, said first surface of said second protective film being in facing engagement with said second surface of said second membrane;

(g) a filling material positioned within said cavity; and (h) a third impermeable membrane having a first surface and a second surface, said first surface of said third membrane being in facing engagement with said second surface of said first protective film and said second surface of said second protective film, said third membrane extending across said cavity such that said first panel, said second panel and said cavity are impermeable to fluids.

10. A sealed joint for a tunnel barrier system, the tunnel barrier system including a first panel having a first surface, a second surface, and a side surface defining a periphery of the first panel; a first impermeable membrane having a first surface and a second surface, the first surface of the first membrane being affixed to the second surface of the first panel such that the first surface of the first membrane is in facing engagement with the second surface of the first panel; a second panel having a first surface, a second surface, and a side surface defining a periphery of the second panel, a portion of the side surface of the first panel is positioned adjacent to but spaced apart from a portion of the side surface of the second panel such that a cavity is formed between a portion of the side surface of the first panel and a portion of the side surface of the second panel; and a second impermeable membrane having a first surface and a second surface, the first surface of the second membrane being affixed to the second surface of the second panel such that the first surface of the second membrane is in facing engagement with the second surface of the second panel, the sealed joint comprising:

(a) a filling material positioned within the cavity; and (b) a third impermeable membrane having a first surface and a second surface, said first surface of said third membrane being in facing engagement with the second surface of the first membrane and the second surface of the second membrane, said third membrane extending across the cavity such that the first panel, the second panel and the cavity are impermeable to fluids.

11. The sealed joint of claim 10, wherein said filling material comprises:

(a) a closed cell backer rod positioned within the cavity;

(b) a sealant positioned within the cavity proximate to said backer rod; and (c) a compression seal positioned within the cavity proximate to said sealant.

12. The sealed joint of claim 11, wherein said sealant comprises polyurethane.

13. The sealed joint of claim 11, wherein said compression seal comprises neoprene.

14. A method for lining an interior surface of a tunnel cavity, said method comprising the steps of:

(a) installing a first panel having a first surface, a second surface, and a side surface defining a periphery of said first panel in the tunnel cavity such that said first surface of said first panel is in facing relationship with the interior surface;

(b) installing a second panel having a first surface, a second surface, and a side surface defining a periphery of said second panel in the tunnel cavity such that said first surface of said second panel is in facing relationship with the interior surface and a portion of said side surface of said second panel is positioned adjacent to but spaced apart from a portion of said side surface of said first panel such that a cavity is formed between said portion of said side surface of said first panel and said portion of said side surface of said second panel;

(c) affixing a first impermeable membrane having a first surface and a second surface to said first panel such that said first surface of said first membrane is in facing engagement with said second surface of said first panel;

(d) affixing a second impermeable membrane having a first surface and a second surface to said second panel such that said first surface of said second membrane is in facing engagement with said second surface of said second panel;

(e) inserting a filling material into said cavity; and (f) affixing a third impermeable membrane having a first surface and a second surface to a portion of said second surface of said first membrane and a portion of said second surface of said second membrane such that said third membrane extends across said cavity whereby said first panel, said second panel and said cavity are impermeable to fluids.

15. The method of claim 14, wherein the step of inserting said filling material into said cavity comprises the steps of:

(a) inserting a closed cell backer rod into said cavity;

(b) inserting a sealant into said cavity; and (c) inserting a compression seal within said cavity.

* * * * *